US009585505B2

(12) United States Patent
Meline

(10) Patent No.: US 9,585,505 B2
(45) Date of Patent: Mar. 7, 2017

(54) PROTECTIVE DEVICE FOR GLASSWARE

(71) Applicant: Pint Cones, LLC, Edmonds, WA (US)

(72) Inventor: Austin Meline, Edmonds, WA (US)

(73) Assignee: Pint Cones, LLC, Edmonds, WA (US)

( * ) Notice: Subject to any disclaimer, the term of this patent is extended or adjusted under 35 U.S.C. 154(b) by 0 days.

(21) Appl. No.: 14/641,077

(22) Filed: Mar. 6, 2015

(65) Prior Publication Data

US 2016/0255975 A1 Sep. 8, 2016

(51) Int. Cl.
*A47G 19/23* (2006.01)
*A47G 23/02* (2006.01)

(52) U.S. Cl.
CPC ..... *A47G 23/0208* (2013.01); *A47G 19/23* (2013.01)

(58) Field of Classification Search
CPC .... A47G 23/0208; A47G 19/23; A47G 23/02; B65D 21/00; B65D 21/02; B65D 21/0226; B65D 21/0233
USPC ..... 220/23.83, 23.6, 23.86, 23.88, 694, 737; 206/499, 505, 515, 519
See application file for complete search history.

(56) References Cited

U.S. PATENT DOCUMENTS

| | | | | |
|---|---|---|---|---|
| 378,361 | A * | 2/1888 | Fox | 215/395 |
| 2,215,411 | A * | 9/1940 | Sebring | A47G 23/0241 215/395 |
| 4,623,112 | A * | 11/1986 | Olson | A47G 23/0216 248/153 |
| 4,978,019 | A * | 12/1990 | Maroudas | A47G 19/30 206/457 |
| 5,533,700 | A * | 7/1996 | Porter | 248/311.2 |
| 5,704,671 | A * | 1/1998 | van der Wal | A47G 23/0216 220/738 |
| 5,762,195 | A * | 6/1998 | Stevens | 206/499 |
| 8,978,906 | B2 * | 3/2015 | Feeley et al. | 215/11.6 |

* cited by examiner

*Primary Examiner* — Robert J Hicks
*Assistant Examiner* — Kareen Thomas
(74) *Attorney, Agent, or Firm* — Mark P. Walters; Lowe Graham Jones PLLC

(57) ABSTRACT

The invention relates to the protection of glasses and glassware in the hospitality and bar industry. Specifically, the device provides for a rubberized or plastic nesting device sized to fit on the outside of glassware, such as for example, a pint glass, whereby the plastic nesting device permits multiple glasses to nest and save space during cleaning and storage and preventing the direct contact of the sides of the glassware that might lead to breaking.

20 Claims, 7 Drawing Sheets

PROTECTIVE DEVICE FOR GLASSWARE

FIELD OF THE INVENTION

The invention pertains to devices for protecting against the breakage of glassware, namely, glassware that is stored in a nested arrangement or nested configuration.

BACKGROUND OF THE INVENTION

Glassware such as that used in a bar, restaurant, or any other establishment engaged in the service of cocktails, beer, or wine, must be stored in sufficient quantities to meet the needs of the establishment over the course of a day or evening. Typically, this glassware is stored on crowded tables, in cupboards, or on shelves, where there is a need to minimize the amount of space consumed by the glassware. In order to conserve space, glassware is commonly "nested," i.e., stacked so that the bottom of one glass is placed inside of a second glass, and where the bottom of the second glass is placed inside of a third glass, and so on. Nesting arrangements such as this exist with as few as two glasses and may include upwards of a dozen, and sometimes more, in a single, contiguous, nested arrangement.

When glassware is stored in a nested arrangement, it is relatively common for the glasses to become stuck together, where the bottom of one glass is not easily removed from the inside of the second glass. Sometimes stacks of nested glassware become stuck in this way; where considerable force is required to remove the glasses from the nested arrangement. Where considerable force is required to dislodge glassware from a nested arrangement, an increased risk exists such that one or more glasses will break during the dislodging process. Over the course of a year, a restaurant, bar, or other establishment will spend thousands of dollars, sometimes tens of thousands of dollars, replacing broken glassware that has broken after becoming stuck in a nested arrangement or configuration. Additionally, bar keeps, bar tenders, and any other workers trying to dislodge stuck glassware from a nested arrangement may accidentally injure themselves or others with shards of broken glass. Still more danger is created from the shards of broken glass which accidentally find their way into ice chests, coolers, and sometimes into the icy drinks of unsuspecting customers.

In addition to creating a risk of injury from glassware breakage during the dislodging of stuck glassware stored in a nested arrangement, the act of nesting glassware i.e., physically placing the bottom of one glass into the opening of a second glass, can cause the bottom of the first glass to strike the rim of the second glass, causing the rim of the second glass to chip or break. This problem of breaking or chipping the rims of glassware exists because the bottoms of most glasses are made from heavy, thick layers of glass, where the rims of those same glasses are typically thin, and relatively prone to chipping and breaking. Where the rim of one glass is chipped or contains some other imperfection, the chip may cause injury to a customer and the imperfection or chip can also lessen or diminish the presentation of the contents of the glass when served to the customer. For example, a pint glass used to serve beer with thick foam will fail to hold adequate foam (or "head") where the rim of the pint glass has imperfections or chips.

Accordingly, there is a need for a device or method permitting or providing for the efficient, space-conserving storage of large inventories of glassware in a nested arrangement or configuration while at the same time avoiding or minimizing the attendant risks associated with such a practice, including the risk of glassware breaking after the same has become stuck, or the risk of glassware becoming broken, chipped, or impaired during the nesting process.

SUMMARY OF THE INVENTION

The invention includes a glassware nesting device comprised of a plurality of prongs extending vertically from a shared, generally planar base member where the prongs are spaced apart from each other and form a receiving space for a glass, where the glass has a rim and a bottom surface, the bottom surface having an inner portion and an outside edge, and where the generally planar base member includes a supporting surface configured to partially envelop the outside edge of the bottom surface of the glass.

The invention also includes a glassware nesting device comprised of a generally planar base member including a plurality of finger-shaped prongs, each extending vertically from a generally planar base member and spaced apart from each other forming a receiving space for a glass, where the glass has a rim and a bottom surface, the bottom surface having an inner portion and an outside edge, and where the generally planar base member includes a supporting surface configured to partially envelop the outside edge of the bottom surface of the glass.

The invention also includes a plurality of glassware stacked in a nested configuration, wherein the plurality includes at least one glassware nesting device interposed between pieces of glassware in said plurality of glassware, wherein the glassware nesting device comprises a plurality of prongs extending vertically from a shared, generally planar base member where the prongs are spaced apart from each other and form a receiving space for a glass, where the glass has a rim and a bottom surface, the bottom surface having an inner portion and an outside edge, and where the generally planar base member includes a supporting surface configured to partially envelop the outside edge of the bottom surface of the glass

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
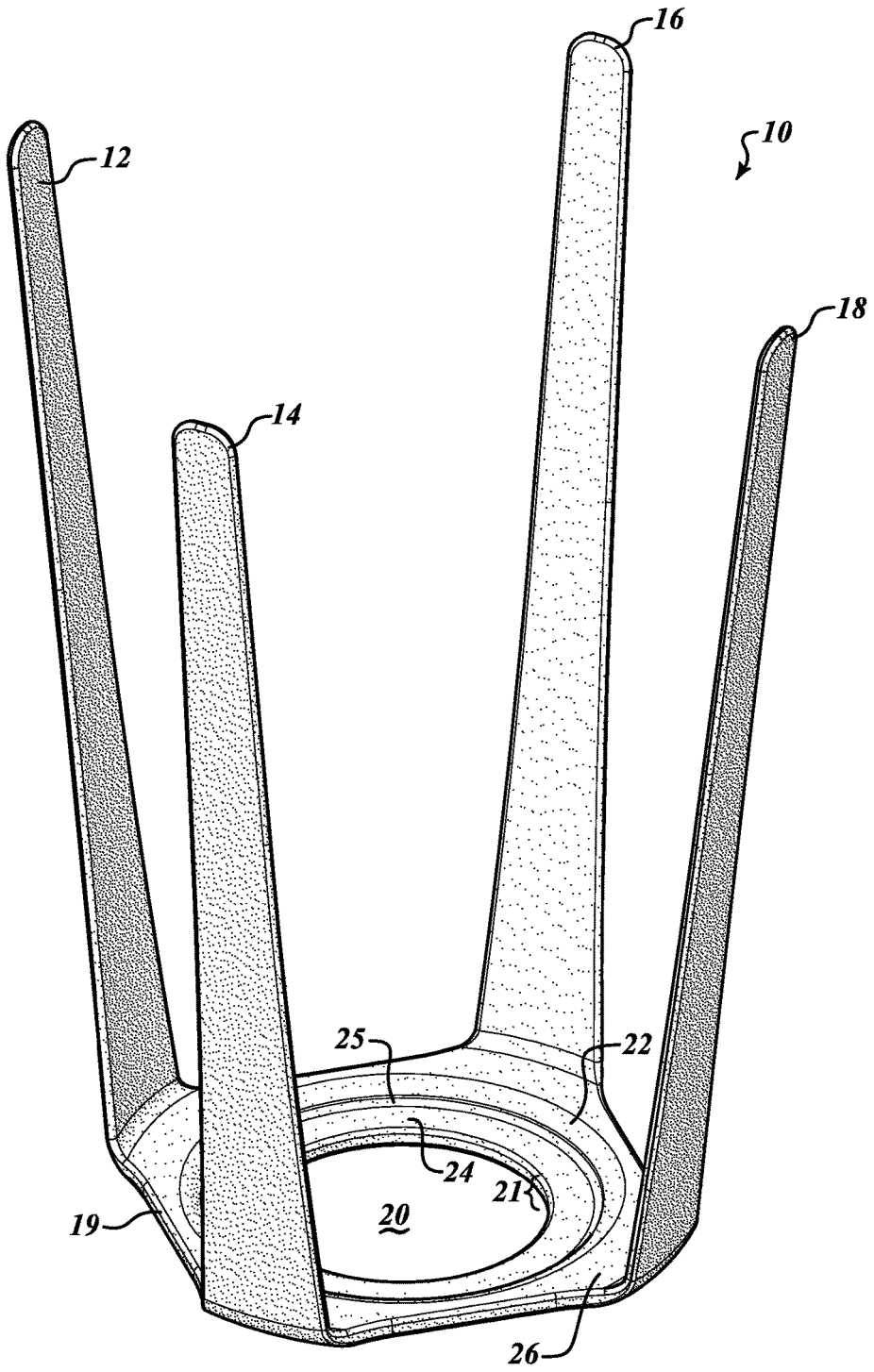
FIG. 1 is an isometric, top, perspective view of a glassware nesting device constructed in accordance with principles of the present invention.

FIG. 1 discloses an embodiment of the invention, namely an embodiment usable to protect against the breaking of pint glasses. As shown in FIG. 1, which is an isometric, top, perspective view of glassware nesting device 10, wherein glassware nesting device 10 includes a first prong 12 that is integrally formed with a generally planar base member, along with second prong 14, third prong 16, and fourth prong 18. The generally planar base member 19 includes a supporting surface 26 and shock absorber 21, where the shock absorber is preferably shaped like a donut, including a center opening 20. The donut-shaped shock absorber 21 includes a top surface 24 and a bottom surface 28 (seen in FIG. 2). The shock absorber 21 is connected to the generally planar base member by a ring-shaped bevel 22.

Figure 2:
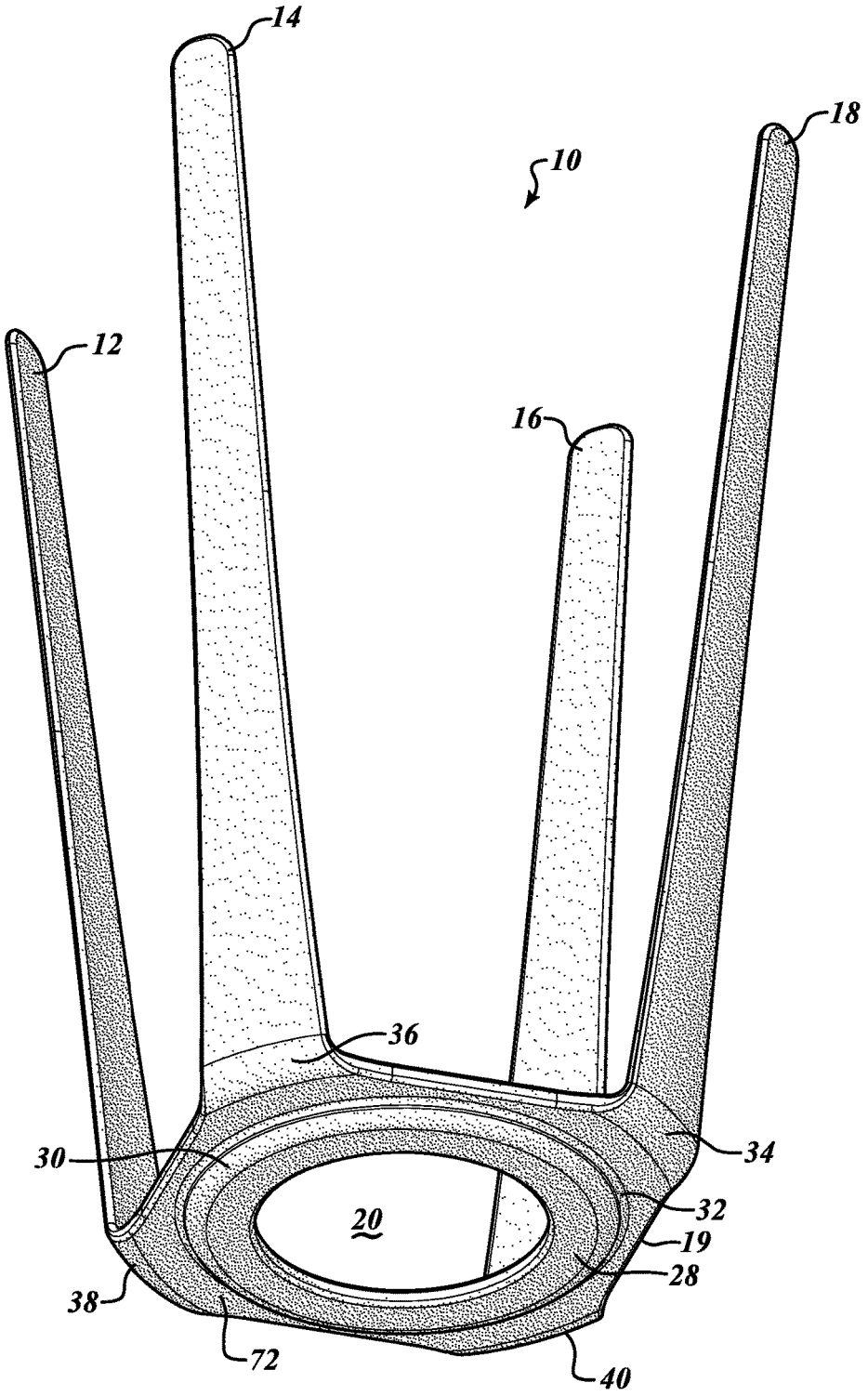
FIG. 2 is an isometric, bottom, perspective view of a glassware nesting device constructed in accordance with principles of the present invention.
Figure 3:
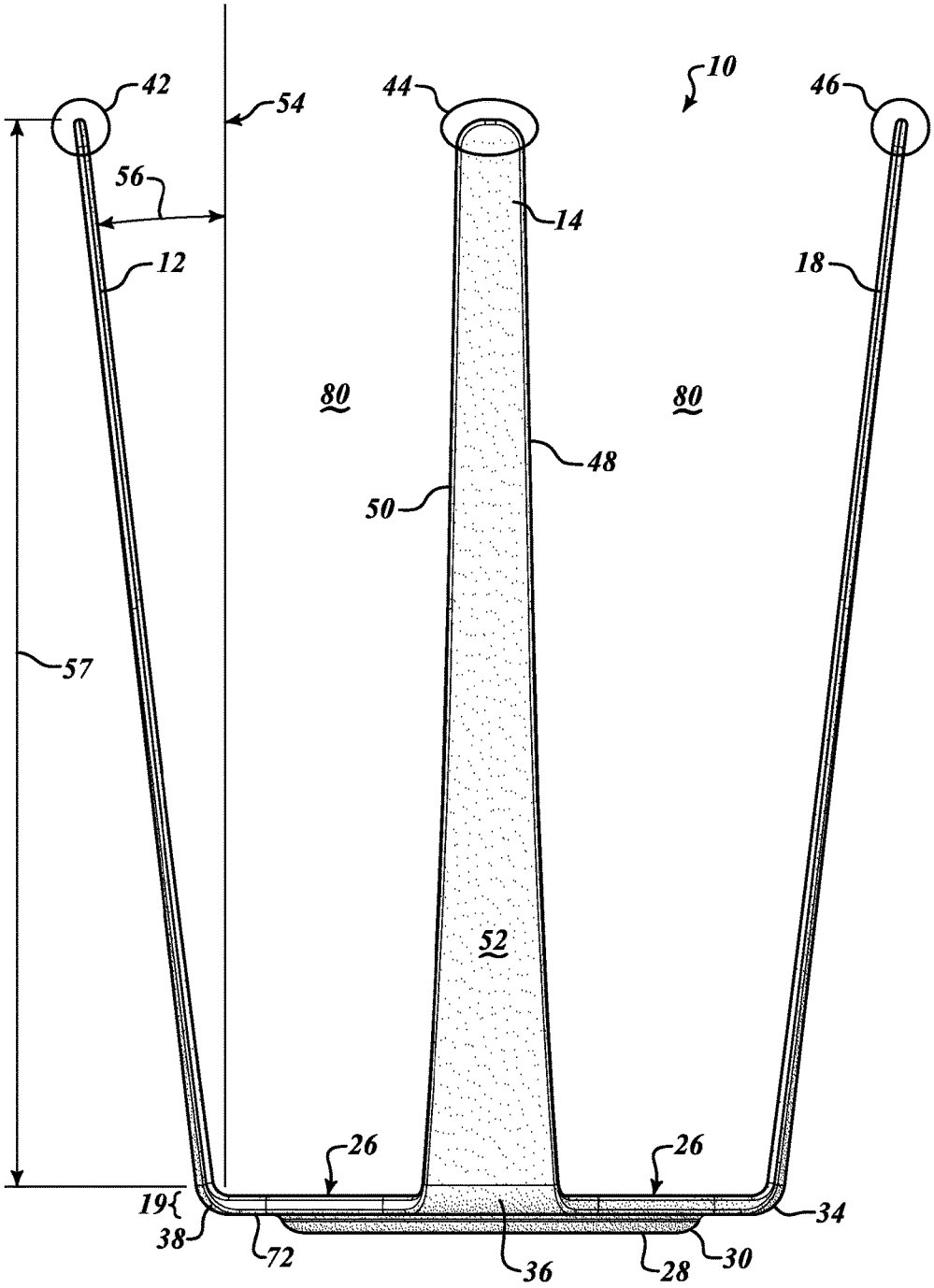
FIG. 3 is a side, planar view of a glassware nesting device constructed in accordance with principles of the present invention.
Figure 6:
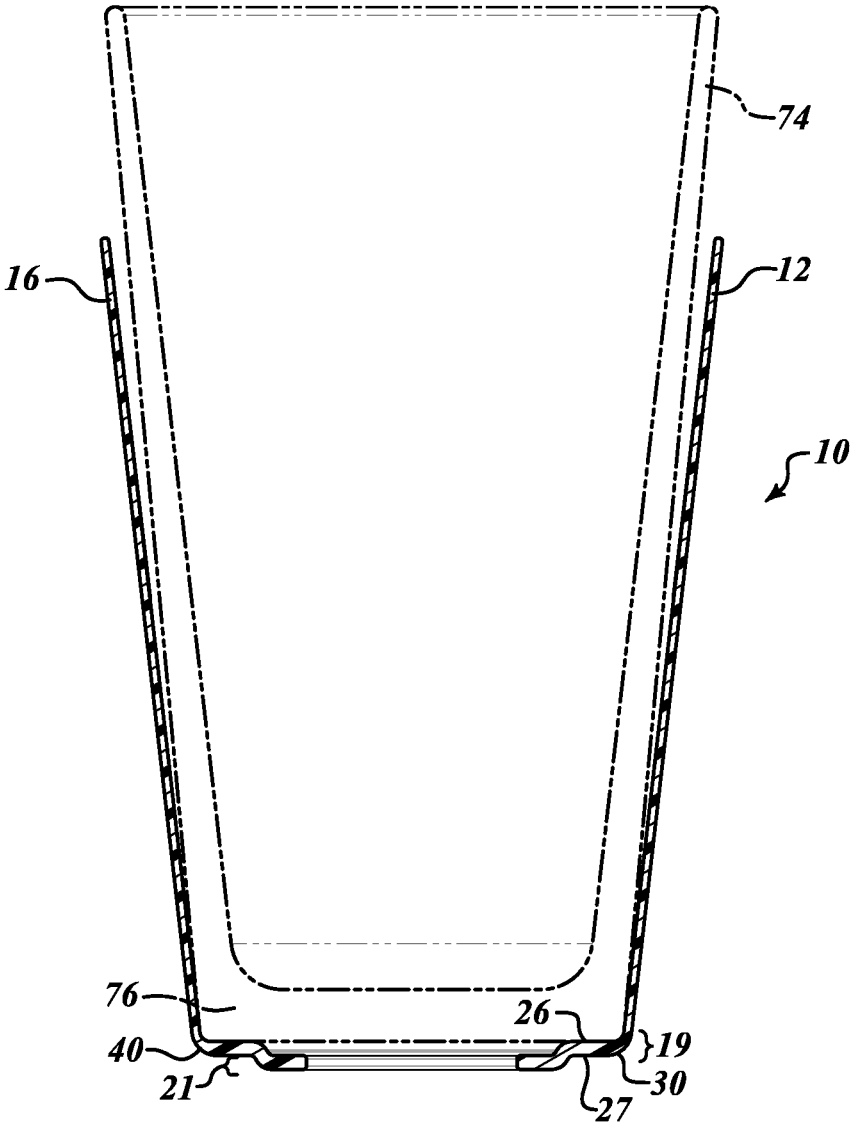
FIG. 6 is a side, sectional view of a glassware nesting device constructed in accordance with principles of the present invention and shown with a representative glass (shown in dotted or dashed lines, and also in side, sectional view).
Figure 7:
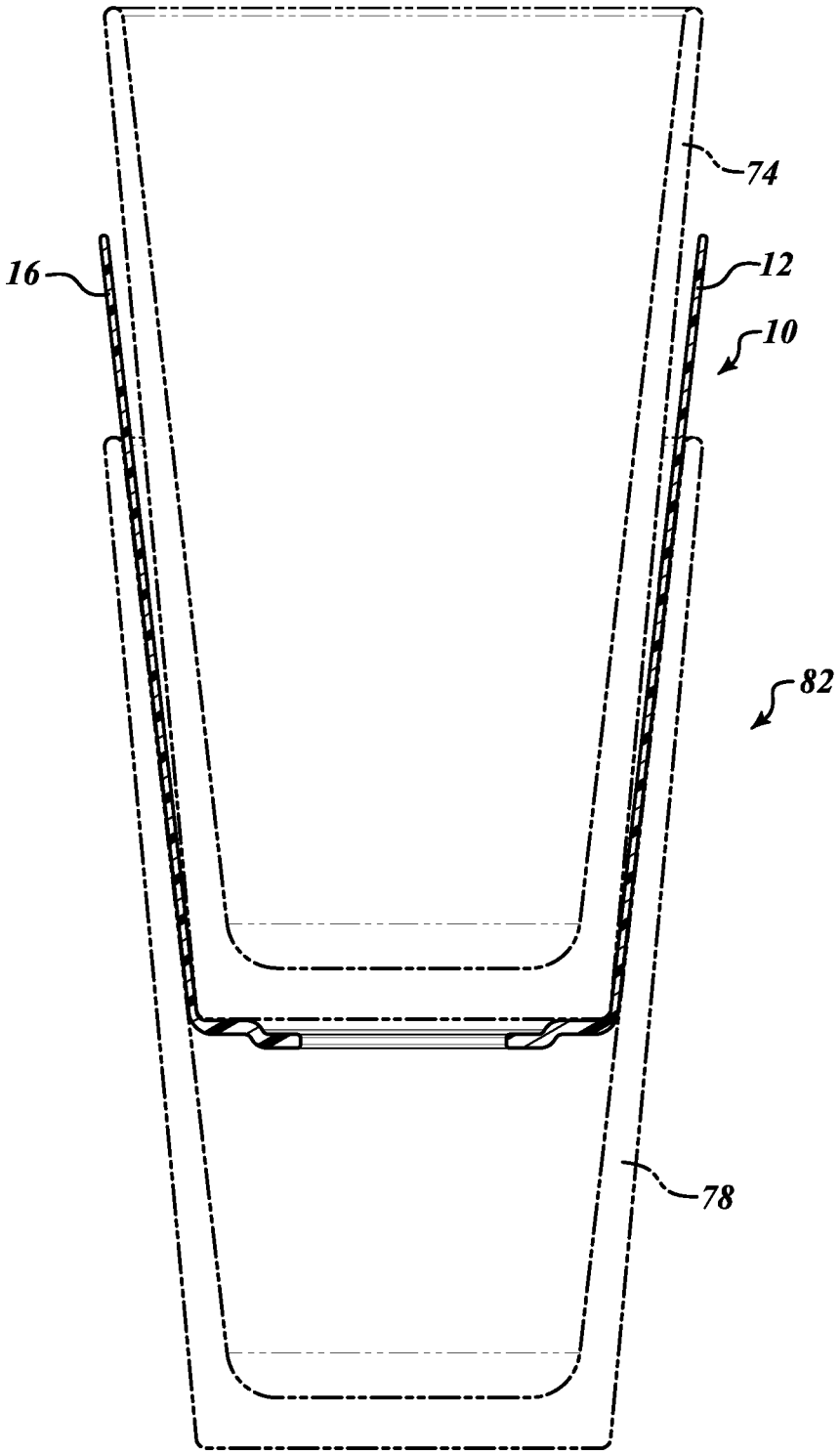
FIG. 7 is a side, sectional view of a glassware nesting device constructed in accordance with principles of the present invention and shown with two representative glasses stacked in a nested arrangement (where the glasses are shown in dotted or dashed lines, and also in side, sectional view).

As shown in FIGS. 1, 2, and 3, the shock absorber 21 is situated beneath the generally planar base member 19. In operation, the shock absorber will deform in response to impact to the bottom surface 28, causing the shock absorber to move slightly vertically at bevels 22 and 23 as well as the drop ring 25 (as seen from above in FIGS. 1) and 32 (as seen from below in FIG. 2. The shock absorber preferably deforms under impact in a manner that protects a piece of glassware from breaking either when the glassware is dropped, or when the glassware is inserted into another piece of glassware in a nested arrangement as shown in FIGS. 6 and 7.

As seen in FIGS. 1 and 2, a plurality of prongs 12, 16, 14, and 18 extend vertically from the shared, generally planar base member. Each prong is preferably shaped like a finger, with a relatively narrow profile. The thickness of each prong is preferably less than a quarter inch, such that nesting device 10 takes up the least amount of volume, thereby enabling more glasses to be stacked in a nested configuration for a predetermined allotted space for such a stack of nested glassware FIG. 2 shows the bottom of the glassware nesting device 10 as well as the outer ring of the shock absorber 32, which is the point at which the shock absorber preferably deforms in response to impact from underneath the glassware nesting device 10. Rounded bottom, outside corners 34, 35, 36, and 38 provide the base ends of each finger-shaped prong. These rounded corners, 34, 35, 36, and 38 are rounded to permit easy sliding of the glassware nesting device 10 into the mouth of another glass as seen in FIG. 7.

FIG. 2 shows the glassware nesting device 10 from the bottom, where the underside of the supporting surface 22 can be seen. The generally planar base member 19, as seen best in FIGS. 1-3 is designed in conjunction with the rounded corners 34, 35, 36, and 38 to partially envelop the outside bottom edge of a pint glass as seen in FIG. 6. The pint glass 74 slides into the glassware nesting device 10. The generally planar base member 19 at least partially envelops the outside, bottom edge 76 of the pint glass 74, protecting that outside, bottom edge 76 from impacts on the side (at rounded corners 34, 35, 36, and 38) and bottom (by surface 72). In this particular embodiment, parts of the outside bottom edge 76 of pint glass 74 remain exposed, however, it is contemplated by the invention that in other embodiments, the entire outside, bottom edge 76 of pint glass 74 will be enveloped. By partially enveloping the outside, bottom edge 76 of pint glass 74, glassware nesting device 10 uses a lower amount of material and it is easier to slide onto the pint glass 74 and partially envelop the bottom surface of the pint glass 74. With continuing reference to FIG. 6, the donut-shaped shock absorber 21 sits underneath the generally planar base member and provides additional protection to the underside of the pint glass 74.

With reference now to FIG. 3, a glassware nesting device 10 constructed in accordance with principles of the invention is further described. The plurality of finger-shaped prongs rise from a shared, generally planar base member 19 and transition from said base member at rounded corners. The rounded corners 34 and 38 are best seen in FIG. 3 when the device is shown in side profile view. Each finger-shaped prong is shaped with a narrow profile, with rounded top edges, 44, 46, and 42. The plurality of finger-shaped prongs extend at an angle 56 away from a line 54 that is normal to the plane in which generally planar base member 19 is disposed. For example, as seen in FIG. 3, the angling away of the fourth finger-shaped prong 18, and the first finger-shaped prong 12 can be seen to define an area 80 that is disposed between these two prongs. This same area, when imagined in 3 dimensions is also disposed between second finger-shaped prong 14 (which is facing the viewer in FIG. 3) and the third finger-shaped prong 16 (which is obscured from view in FIG. 3). This receiving area 80 is sized to receive the bottom of a pint glass as shown in FIG. 6, and when the glassware nesting device receives a pint glass 74 as shown in FIG. 6, the glassware device 10 and pint glass 74, fully nested in the device 10, can be inserted into another pint glass 78 as seen in FIG. 7. When glassware device 10 holds glass 74 and when this assembly slides inside another glass 78, a plurality of glassware stacked in a nested configuration 82 is created. If more glassware nesting devices are available, they can in-turn be placed on additional pieces of glassware. For example, another glassware nesting device may be placed on the pint glass 78, and then the plurality of glassware stacked in a nested configuration 82 will grow by one. The invention contemplates any number of glasses stacked in a nested arrangement as disclosed in FIG. 7.

With further reference to FIG. 3, the outside surface 52 of second finger-shaped prong is disclosed, as surrounded by the side profiles 50 and 48. Side profiles 50 and 48 are preferably less than 10 degrees from vertical, creating a tapered effect and shaped to the prong. The finger-shaped prong has an outside surface 52 that has a predetermined coefficient of friction at a level that is low enough to permit the outside of the glassware nesting device 10, at surface 52, to easily slip inside of another piece of glassware, but at the same time, high enough that the glassware nesting device 10 does not become too wedged within the mouth of a pint glass. As seen in FIG. 3, glassware nesting device 10 has an overall height 57 that is preferably more than 2 inches but less than 6 inches. The overall height 57 of glassware nesting device 10 is adjustable to suit the glass, such that the prongs to not extend beyond the rim of the glass as seen in FIG. 6.

Suitable materials for construction of the glassware nesting device include polyethylene and polypropylene plastics, such as HDPE, LDPE, LLDPE. While other materials may also be suitable, these materials are preferable because they provide the right amount of friction when the glassware nesting device 10 is inserted on a pint glass 74 as shown in FIG. 6 and when the glass 76 and nesting device 10 are inserted into another glass 78 as seen in FIG. 7.

Figure 4:
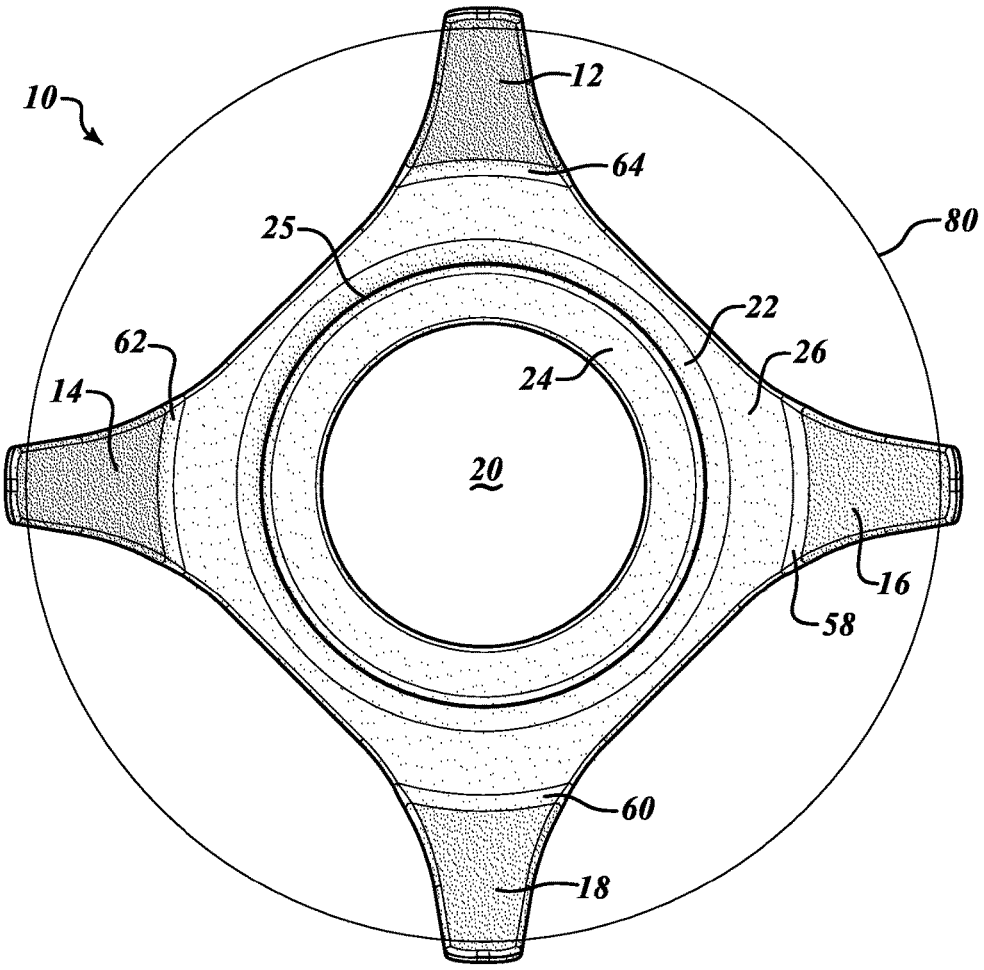
FIG. 4 is a top, planar view of a glassware nesting device constructed in accordance with principles of the present invention.

As seen FIGS. 2 and 3, an embodiment of the invention for pint glasses is disclosed with a plurality of finger-shaped prongs, namely four in number. These prongs extend radially away from a circular center as seen in FIG. 4. They form a receiving space 80 seen in FIG. 4 by the circular line 80. In the depicted embodiment, the receiving space 80 is sized to receive the bottom of a pint glass, however, other glasses are useable with the present invention, and the invention is not limited to pint glasses. Moreover, different shapes for glasses are contemplated by the invention, including triangles, squares, and other shapes.

When used for pint glasses, the number of finger-shaped prongs is preferably 4 prongs, because this provides an adequate amount of protection against glass-on-glass contact. Glass-on-glass contact leads to breakage and lodging among glasses stored in a nested configuration. So having four prongs, of the general size a shape disclosed in FIGS. 1-5, will prevent against glass-on-glass contact in a manner that reduces the chance for breakage or lodging when pint glasses are arranged in a nested configuration.

Figure 5:
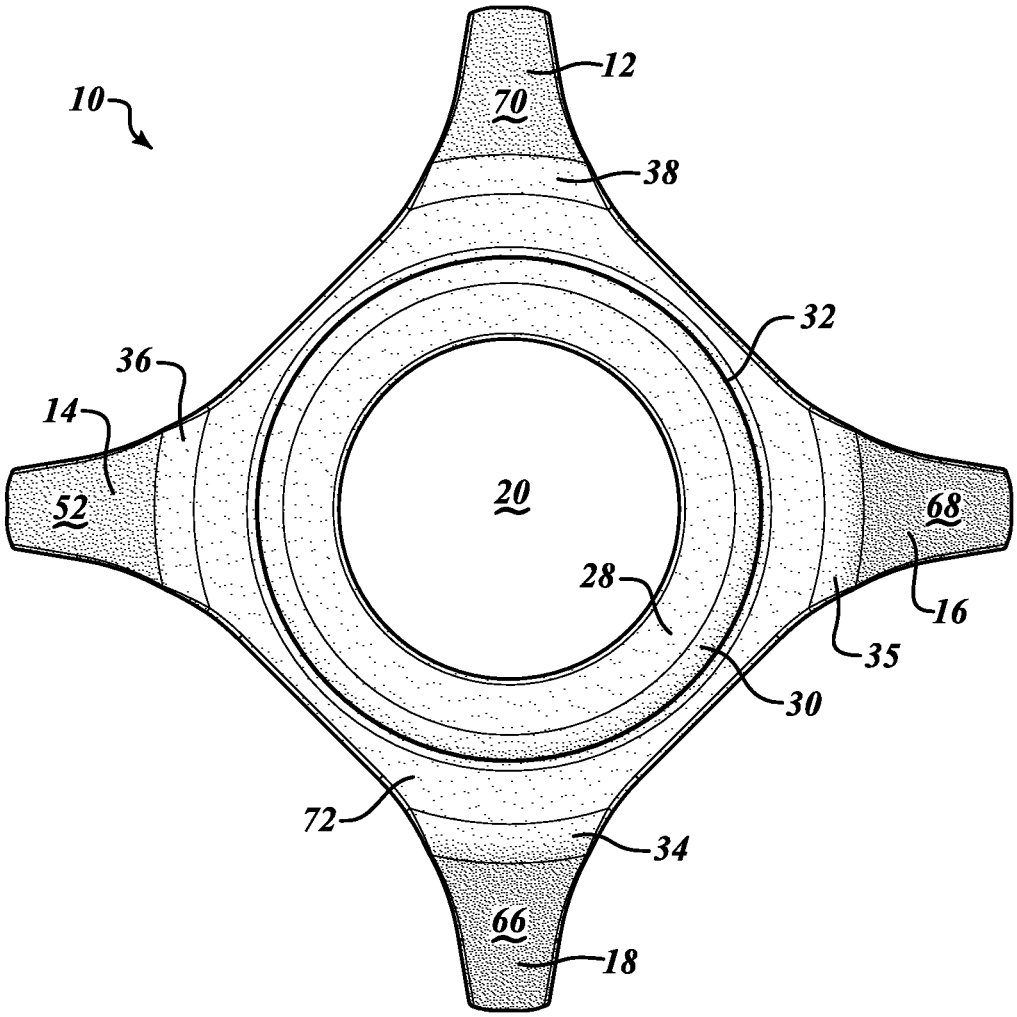
FIG. 5 is a bottom, planar view of a glassware nesting device constructed in accordance with principles of the present invention.

With reference to FIG. 5, the bottom of glassware nesting device 10 is described. The bottom side of glassware nesting device 10 includes four rounded corners, 35, 34, 38, and 36. These rounded corners are preferably made from a material that permits the glassware nesting device 10 to slide easily into the mouth of a pint glass. To this end, the material will have a predetermined coefficient of friction at a level that is low enough to permit the outside of the glassware nesting device 10, at rounded corners 35, 34, 38, and 36, to easily slip inside of another piece of glassware. As also seen in FIG. 5, the bottom side 72 of supporting surface 26 is seen. Additionally, the bottom surface 28 of donut-shaped shock absorber is also seen disposed within the bevel 30. Together, the bevel 30 and the outer ring of shock absorber 32 are configured to permit deformation of the shock absorber 21 from an underside impact, translating into deceleration of the glass and glassware nesting device combination (as seen in FIG. 6), and protection of the glass 74 from breakage.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A glassware nesting device for a glass comprising:

a plurality of prongs extending vertically from an integrally formed and generally planar base member, each prong having a narrow profile of less than a quarter inch, each prong extending from a rounded corner of the base member to a distal end, wherein the base member is plastic and has a center, wherein the center is surrounded by a beveled ring and a drop ring, and wherein the prongs are spaced apart from each other and form a receiving space for a glass, the glass having a rim and a bottom surface, the bottom surface having an inner portion and an outside edge, and wherein the generally planar base member includes a supporting surface configured to partially envelop the outside edge of the bottom surface of the glass.

2. The glassware nesting device of claim 1 wherein the generally planar base member includes a shock absorber, wherein the shock absorber is provided underneath the generally planar base member.

3. The glassware nesting device of claim 1 wherein each of the plurality of prongs is angled radially away from the center of the generally planar base member, at an angle that is more than zero degrees from vertical but less than ten degrees from vertical, said angle being the same at all points along each prong.

4. The glassware nesting device of claim 1 wherein the plurality of prongs includes at least 3 prongs.

5. The glassware nesting device of claim 1 wherein the plurality of prongs includes at least 4 prongs.

6. The glassware nesting device of claim 1 wherein the plurality of prongs includes at least 3 but not more than 4 prongs.

7. The glassware nesting device of claim 1 wherein the device is constructed at least partially from a polyethylene plastic material.

8. The glassware nesting device of claim 1 wherein the device is constructed at least partially from a polypropylene plastic material.

9. A glassware nesting device for a glass comprising:

an integrally formed, generally planar base member, wherein said base member is constructed from plastic and includes a plurality of finger-shaped prongs, each prong having a narrow profile of less than a quarter inch, each prong extending from a rounded corner to a distal end, and each prong extending vertically from the generally planar base member and spaced apart from each other prong forming a receiving space for one or more nested glasses, wherein each glass has a rim and a bottom surface, the bottom surface having an inner portion and an outside edge, and wherein the generally planar base member includes a supporting surface and a center, wherein the center is surrounded by a beveled ring and a drop ring and wherein the supporting surface is configured to partially envelop the outside edge of the bottom surface of one of the glasses.

10. The glassware nesting device of claim 9 wherein the generally planar base member includes a shock absorber, wherein the shock absorber is provided underneath the generally planar base member.

11. The glassware nesting device of claim 9 wherein each of the plurality of finger-shaped prongs is angled radially away from the center of the generally planar base member, at an angle that is more than zero degrees from vertical but less than ten degrees from vertical, said angle being the same at all points along each prong.

12. The glassware nesting device of claim 9 wherein the plurality of finger-shaped prongs includes at least 3 finger-shaped prongs.

13. The glassware nesting device of claim 9 wherein the plurality of finger-shaped prongs includes at least 4 finger-shaped prongs.

14. The glassware nesting device of claim 9 wherein the plurality of finger-shaped prongs includes at least 3 but no more than 4 finger-shaped prongs.

15. The glassware nesting device of claim 9 wherein the device is constructed at least partially from a polyethylene plastic material.

16. The glassware nesting device of claim 9 wherein the device is constructed at least partially from a polypropylene plastic material.

17. A plurality of glassware stacked in a nested configuration comprising:

at least one glassware nesting device interposed between pieces of glassware in said plurality of glassware, wherein the glassware nesting device comprises a plurality of prongs, each prong having a narrow profile of less than a quarter inch, each prong extending from a rounded corner to a distal end and extending vertically from a shared, generally planar, plastic base member wherein the prongs are spaced apart from each other and form a receiving space for a glass, wherein the glass has a rim and a bottom surface, the bottom surface having an inner portion and an outside edge, and wherein the generally planar base member includes a supporting surface and a center, wherein the center is surrounded by a beveled ring and a drop ring and wherein the supporting surface is configured to partially envelop the outside edge of the bottom surface of the glass.

18. The plurality of glassware stacked in a nested configuration of claim 17, wherein the generally planar base member includes a shock absorber, wherein the shock absorber is provided underneath the generally planar base member.

19. The plurality of glassware stacked in a nested configuration of claim 17, wherein each of the plurality of prongs is angled away from a center of the generally planar base member, at an angle that is more than zero degrees from vertical but less than ten degrees from vertical, said angle being the same at all points along each prong.

20. The plurality of glassware stacked in a nested configuration of claim 17, wherein the plurality of prongs includes at least 3 prongs.

* * * * *